US007568818B2

(12) United States Patent
Pfund

(10) Patent No.: US 7,568,818 B2
(45) Date of Patent: Aug. 4, 2009

(54) LAMP DISTRIBUTION MODIFIER AND LUMINAIRE HAVING THE SAME

(75) Inventor: David Pfund, Woodbridge, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 0 days.

(21) Appl. No.: 11/405,394

(22) Filed: Apr. 17, 2006

(65) Prior Publication Data

US 2006/0232960 A1 Oct. 19, 2006

Related U.S. Application Data

(60) Provisional application No. 60/671,980, filed on Apr. 15, 2005.

(51) Int. Cl.
*F21V 13/08* (2006.01)

(52) U.S. Cl. ..... 362/303; 362/33; 362/260; 362/279; 362/291; 362/298; 362/354; 362/360

(58) Field of Classification Search ..... 362/33, 362/127, 145, 147, 217, 221–225, 260, 279, 362/290–292, 296, 298–300, 303, 306, 344, 362/351, 354, 360, 365
See application file for complete search history.

(56) References Cited

U.S. PATENT DOCUMENTS 4,164,009 A * 8/1979 Maguire, et al. ..... 362/127
4,233,651 A * 11/1980 Fabbri ..... 362/33
4,298,916 A * 11/1981 Shemitz ..... 362/127
4,384,318 A * 5/1983 Reibling ..... 362/216
4,418,378 A * 11/1983 Johnson ..... 362/97
4,434,453 A * 2/1984 Campbell ..... 362/33
4,621,309 A * 11/1986 Grawe et al. ..... 362/342
4,747,025 A * 5/1988 Barton ..... 362/147
5,040,104 A * 8/1991 Huisingh et al. ..... 362/330
5,307,254 A * 4/1994 Russello et al. ..... 362/368
5,530,628 A * 6/1996 Ngai ..... 362/33
5,848,833 A * 12/1998 Margulies et al. ..... 362/147
7,249,870 B1 * 7/2007 Shwisha ..... 362/368
2002/0191400 A1 * 12/2002 Jilk et al. ..... 362/257
2003/0227772 A1 * 12/2003 Yoshida et al. ..... 362/147

* cited by examiner

*Primary Examiner*—Jong-Suk (James) Lee
*Assistant Examiner*—Leah S Lovell
(74) *Attorney, Agent, or Firm*—Cantor Colburn LLP

(57) ABSTRACT

A luminaire for mounting on a vertical surface is provided, the luminaire including a housing having an aperture, a lamp disposed within the aperture and configured to emit light through the aperture to the vertical surface and to an associated worksurface, and a lamp distribution modifier disposed within the aperture proximate to the lamp, where the lamp distribution modifier is configured to intercept light rays emitted by the lamp in a direction toward an upper portion of the vertical surface.

16 Claims, 13 Drawing Sheets

LAMP DISTRIBUTION MODIFIER AND LUMINAIRE HAVING THE SAME

CROSS-REFERENCE TO RELATED APPLICATION

This application is related to and claims the benefit of U.S. Provisional Patent Application Ser. No. 60/671,980 filed on Apr. 15, 2005, the entire contents of which are herein incorporated by reference.

BACKGROUND OF INVENTION (a) Field of Invention

The present invention relates generally to luminaires which are mountable on vertical surfaces. More specifically the invention relates to a panel-mounted luminaire, such as those used with partition panels in modular office furniture systems, where the luminaire is configured to reduce excessive luminance on the vertical surface while still providing sufficient luminance to said vertical surface and/or an associated worksurface.

(b) Description of Related Art

Luminaires are often used in conjunction with conventional modular office furniture systems. Such luminaires may be task lights that direct their output in a downward direction only to illuminate worksurfaces located below the luminaires, ambient lights that direct their output in an upward direction only to illuminate ceilings and give general lighting to the space, or task/ambient luminaires that provide both downward and upward directed light. These luminaires are often fashioned as elongated units suitable for use with linear type fluorescent lamps and are capable of providing broad areas of lighting for horizontal worksurfaces and associated partition panels.

Workstation integrated task and task-ambient luminaires are well known in the industry and are especially effective at achieving quality task illumination in open office environments. Generally, such luminaires are configured to mount on open office workstation partitions, walls, or, as may be the case with those that provide only downward task lighting, to an underside of workstation shelves or elevated storage cabinets (also known as "binder bins").

Linear type fluorescent lamps of nominal 1" diameter (T8) or ⅝" diameter (T5) are the most popular lamps for applications involving these task and task-ambient luminaires. Consequently, installations typically consist of luminaires ranging from 2 feet in length to as much as 8 feet in length, each incorporating 2', 3', 4', or 5' long fluorescent lamps singly or in tandem as dictated by the length of the unit. Common desirable mounting practices typically position the luminaires slightly above seated eye height and coincident to a primary task area of a worksurface generally disposed horizontally some distance beneath the mounted task luminaire. Worksurfaces that are 24 to 30 inches deep (front to back) and 6 to 8 feet long are common and are desirably served by task lighting that extends nearly or completely over an entire length of the worksurface, thus providing broad and relatively uniform areas of task lighting within the workstation.

In addition to lighting the requisite horizontal worksurface, much effort is often taken in the design of such luminaires to similarly illuminate the vertical surface that typically extends upwardly from the edge of the worksurface opposite from the viewer. This vertical surface may be a wall, a privacy partition panel, etc. These efforts are generally directed at alleviating shadowing of overhead ambient lighting by said luminaire, shelf and/or binder bin in an attempt to create a balanced luminous surround for vertically oriented visual tasks (such as VDT viewing) in addition to traditional paper tasks.

Specifically, a desirable visual balance may be achieved when the luminance ratio between a task and the immediately adjacent surroundings (workstation surfaces) does not exceed 3:1 or 1:3. (ref: ANSI/IESNA RP-1-04 American National Standard for Office Lighting). Thus, for the typical VDT screen with an average luminance of 90 candelas per square meter (cd/m$^2$), the vertical workstation panel(s) adjacent to said VDT should have a luminance in the range of 30 to 270 cd/m$^2$. The industry Standards further recommend that such panels have a reflectance of 40% to 70% and be non-specular (i.e. diffuse). Therefore, such luminances are typically realized when such workstation panels are illuminated to 22 to 114 footcandles. However, current task-oriented workstation luminaires often do not provide this luminance balance, thus resulting in visual fatigue and discomfort to the viewer as the worker's eye repeatedly adjusts to disparate luminances in the field of view. Such visual fatigue and discomfort is known to diminish the productivity of the affected worker in performing workstation tasks.

Furthermore, in using such task oriented workstation luminaires, it is often desirable to achieve a narrow profile, i.e., a narrow outward extension from the vertical surface, in order to: (1) achieve a spacious and open feeling workstation; (2) minimize any shadow the luminaire might cast on workstation surfaces due to overhead ambient lighting; (3) minimize any asymmetric weight load/moment on the supporting panel and/or brackets; and (4) minimize fabrication costs associated with larger luminaire units. However, a task luminaire having a smaller cross-section and a corresponding reduced extension from the vertical surface generally places the lamp closer to the vertical surface thus causing luminance of the vertical surface proximate to the aperture to exceed the recommended limits.

Therefore, a luminaire is desired that overcomes these disadvantages and offers improved luminance distribution across a vertical mounting surface and an associated worksurface. Specifically, a luminaire is desired having a lamp distribution modifying feature which reduces luminance on the vertical mounting surface proximate to the luminaire while maintaining sufficient luminance on areas of the mounting surface disposed distally relative to the luminaire and across the associated worksurface, where such feature is discrete so as not to detract from the aesthetics of the luminaire, and where such feature is cost-effectiveness, easy to install, and capable of retrofit and reposition.

SUMMARY OF INVENTION

A luminaire for mounting on a vertical surface is provided, the luminaire including a housing having an aperture, a lamp disposed within the aperture and configured to emit light through the aperture to the vertical surface and to an associated worksurface, and a lamp distribution modifier disposed within the aperture proximate to the lamp, where the lamp distribution modifier is configured to intercept light rays emitted by the lamp in a direction toward an upper portion of the vertical surface.

A lamp distribution modifier is further provided where the modifier is disposed proximate to a lamp within an interior of a downlight luminaire. The modifier generally includes an elongated body configured to extend along at least a part of a length of the lamp, a light passage feature disposed on the body configured to allow first light rays incident on a vertical surface to pass through the lamp distribution modifier, and a light intercepting feature disposed on the body and configured to intercept second light rays incident on the vertical surface. The body is disposed so as not to be directly visible to a viewer of the luminaire.

The invention also provides a method of modifying light incident on a vertical surface emitted by a lamp of a luminaire mounted proximate to the vertical surface. The method includes disposing a lamp distribution modifier at an interior of the luminaire proximate to the lamp so as not to be directly viewable by a viewer of the luminaire, intercepting first light rays at the lamp distribution modifier incident on an upper portion of the vertical surface proximate to the luminaire, and allowing passage of second light rays through the lamp distribution modifier incident on the upper portion of the vertical surface and incident on a lower portion of the vertical surface disposed distal from the luminaire.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
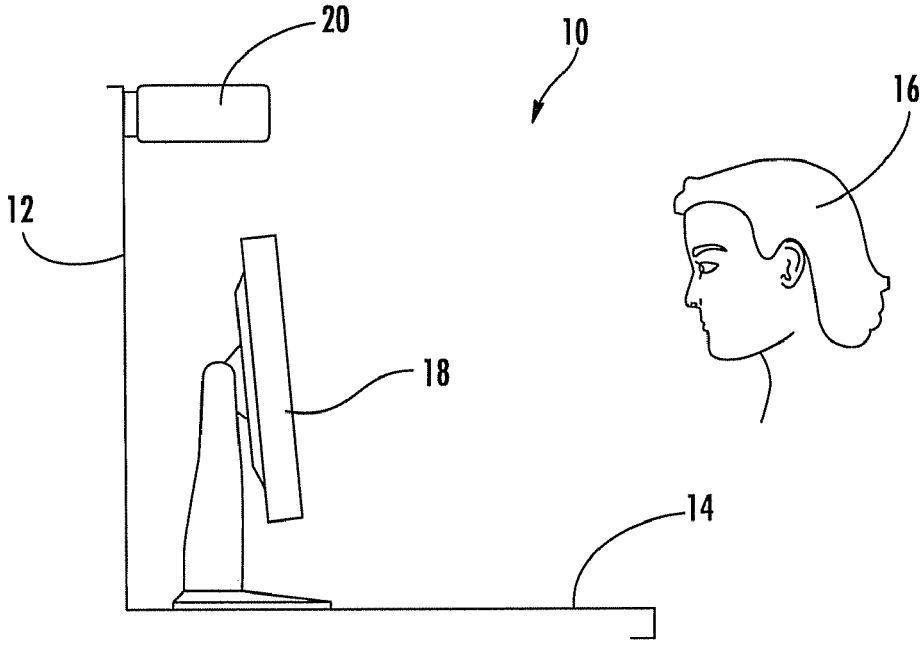
FIG. 1 is a side view of a workstation.

FIG. 1 is a side view of a workstation 10 comprised of a vertical surface 12 and a worksurface 14. The vertical surface may be a wall or a privacy partition common to modular furniture arrangements or any vertical surface sufficient for use in the workstation 10. For simplicity purposes, the vertical surface 12 is herein described as generally being oriented vertically. It shall be understood that this surface 12 may be angled relative to vertical, as desired. The worksurface 14 is shown as a horizontal surface extending generally perpendicularly from the vertical surface 12 in a direction toward a viewer 16 who is disposed in a seated or standing position at the workstation 10. The worksurface 14 may be formed integrally with the vertical surface, attached fixedly thereto, or may be separate therefrom and maybe horizontal, inclined, and/or declined, as desired. An exemplary monitor 18 is positioned on the worksurface 14.

The workstation 10 further includes a luminaire 20 in an exemplary embodiment of the invention. The luminaire 20 is mounted to the vertical surface 12 at a height slightly above the eyes of the viewer 16 and is configured to illuminate the vertical surface 12 and the worksurface 14. The luminaire 20 may be fixed to the vertical surface 12 by any sufficient means including bolts, fasteners, etc. Alternatively, the luminaire 20 may be removably attached to the vertical surface 12 by being hung upon brackets (not shown) which extend from the vertical surface 12 and which are received in a slot or groove formed in a rear section of the luminaire 20. Particularly, the luminaire 20 is mountable on the vertical surface 12 using the bracket configuration disposed in U.S. patent application Ser. No. 11/402,358, entitled, "LUMINAIRE WITH MULTI-PURPOSE MOUNTING FEATURE", filed by David Pfund et al. on Apr. 11, 2006, the entire contents of which are herein incorporated by reference in their entirety. The luminaire 20 extends along the vertical surface 12 in a direction generally parallel to a line formed by the intersection of the vertical surface 12 and the worksurface 14. The luminaire 20 may be of any desired length and is preferably from two feet to eight feet long. The workstation 10 may include a single luminaire 20 or multiple luminaires 20 mounted on the vertical surface adjacent to one another.

Figure 2:
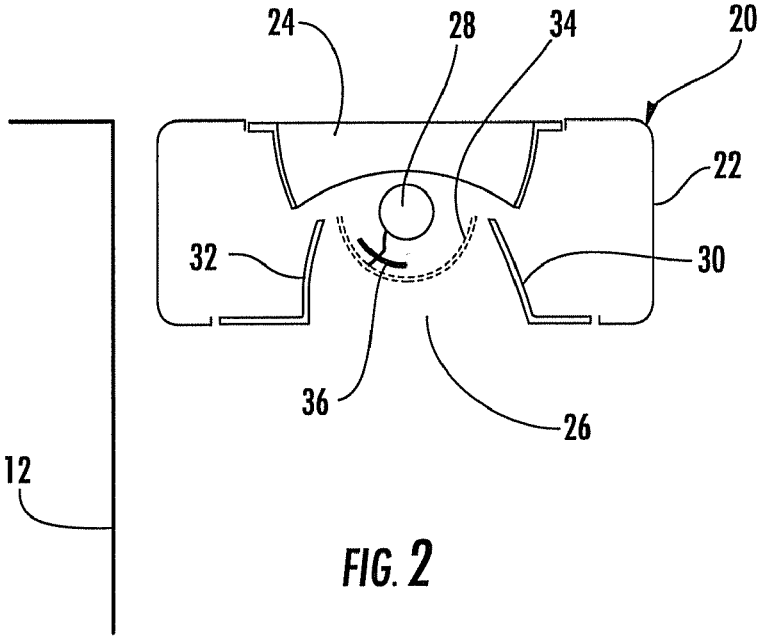
FIG. 2 is a cross-sectional view of a luminaire in an exemplary embodiment of the invention.

FIG. 2 illustrates a cross-section of the luminaire 20 and a portion of the vertical surface 12. As shown, the luminaire 20 includes a housing 22 which delimits an upper aperture 24 and a lower aperture 26. A lamp 28 is disposed within the housing generally between the upper and lower apertures 24 and 26, respectively. The lamp 28 is generally a fluorescent tube lamp and, for example, may be a T8 lamp (one inch diameter) or a T5 lamp (⅝ inch diameter), or any other desired tube lamp fluorescent or otherwise. The lamp 28 is removably disposed within the housing 22 by conventional means comprising one or more lampholder, a ballast, etc. such that the lamp 28 extends along at least a part of the length of luminaire 20. The upper aperture 24 is positioned to allow light emitted from the lamp 28 to emanate upward relative to the luminaire 20. The lower aperture 26 is positioned to allow light emitted from the lamp 28 to emanate downward relative to the luminaire 20.

The luminaire 20 further includes a first reflector 30 and a second reflector 32 disposed within the housing 22 at the aperture 26 on opposite sides of the lamp 28. The first reflector 30 is disposed toward a front of the housing 22. The second reflector is disposed toward a rear of the housing 22 proximate to the vertical surface 12. The first and second reflectors 30 and 32 generally comprise specular members which extend partly or entirely along the length of the lamp 28 and which are configured to receive light emitted from the lamp 28 and to redirect said light toward the vertical surface 12 and/or toward the worksurface 14. The first and second reflectors 30 and 32, in an exemplary embodiment, are those disclosed in U.S. patent application Ser. No. 11/404,356, entitled, "LUMINAIRES HAVING A CONTOURED SURFACE THAT REDIRECTS LIGHT", filed by David Pfund et al. on Apr. 12, 2006, the entire contents of which are herein incorporated by reference in their entirety. The first and second reflectors 30 and 32 are rigidly fixed with in the housing 22 by conventional means such as screws, bolts, etc., or, alternatively may be formed integrally with the housing 22.

The luminaire 20 further optionally includes a lens 34 disposed beneath the lamp 28 within the aperture 26 between the first and second reflectors 30 and 32. The lens 34 partially or entirely surrounds the lamp 28 and includes one or more areas of opacity and/or translucency for regulating light emitted from the lamp 28. The lens 34 may be slidably movable along the length of the lamp 28 or may extend the entire lamp length.

The luminaire 20 additionally includes a lamp distribution modifier 36 disposed within the aperture 26 proximate to the lamp 28 and inside of the lens 34 (if present in the luminaire 20). As will be discussed herein in detail, the lamp distribution modifier 36 is generally disposed and configured to allow certain light rays from the lamp 28 to pass freely therethrough while intercepting other light rays in order to provide the vertical surface 12 and the worksurface 14 with a substantially even light distribution, while at the same time being disposed proximate to the lamp 28 within the housing 22 out of the view of the viewer 16. That is, the lamp distribution modifier 36 allows certain emitted light rays to pass freely therethrough to the first reflector 30, to the second reflector 32, to the vertical surface 12, and/or to the worksurface 14. The lamp distribution modifier 36 further intercepts other light rays directed toward an upper portion (discussed herein below) of the vertical surface 12 in order to prevent overexposure of this portion of the surface 12. The modifier 36 provides these advantages while being disposed within the lower aperture 26 so as not to intercept light rays exiting the luminaire after being advantageously redirected by reflectors 30 and 32 and so as not to be readily visible by the viewer 16 thus not depreciating the aesthetics of the luminaire 20.

Figure 6A:
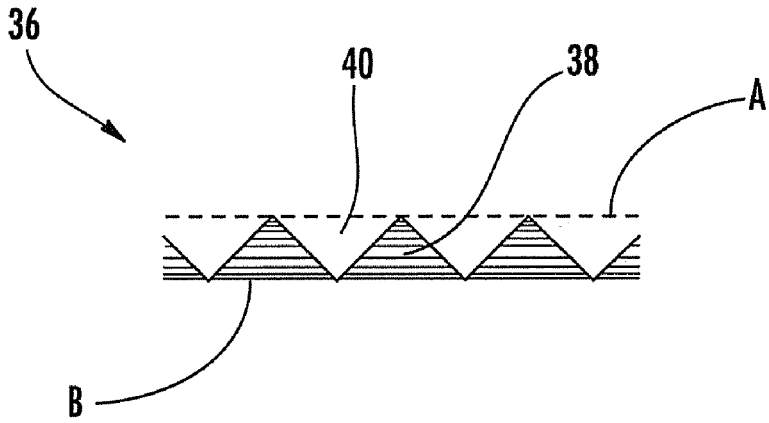
FIG. 6A is an enlarged plan view of a portion of a lamp distribution modifier of the luminaire of FIG. 2, in an exemplary embodiment of the invention.
Figure 6B:
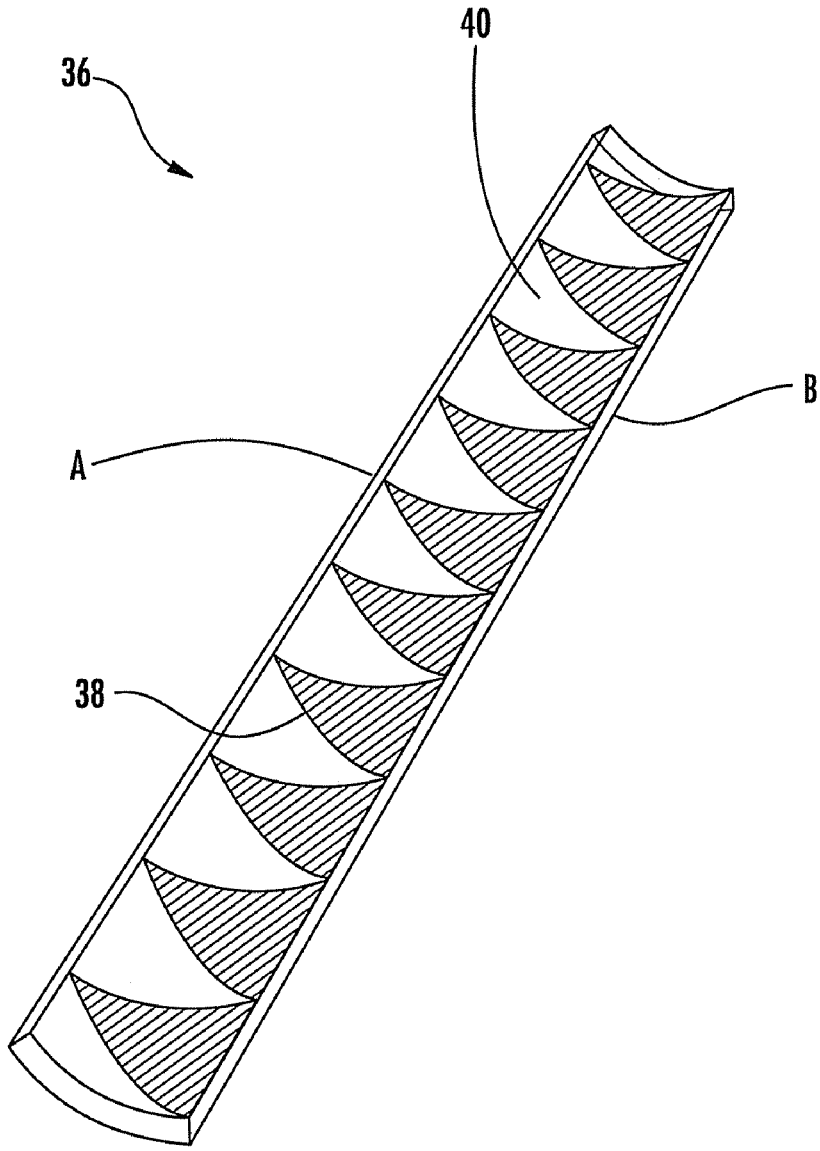
FIG. 6B is a perspective view of lamp distribution modifier of FIG. 6A in another exemplary embodiment of the invention.

The lamp distribution modifier 36 comprises an elongated member which extends partly or entirely along the length of the lamp 28. The lamp distribution modifier 36 may be rigidly fixed within the housing 22 or may be slidably moveable therein. The lamp distribution modifier 36 includes one or more light intercepting features 38 (see, FIGS. 6A, 6B, etc.) which intercept certain light rays emitted from the lamp 28. The lamp distribution modifier 36 further includes one or more light passage features 40 (see, FIGS. 6A, 6B, etc.) which allow certain light rays emitted from the lamp 28 to pass freely from the lamp distribution modifier 36. As alluded to above, the strategic disposition and configuration of the light intercepting and light passage features 38 and 40 result in an even distribution of light from the lamp 28 across the vertical surface 12 and across the worksurface 14.

Figure 3:
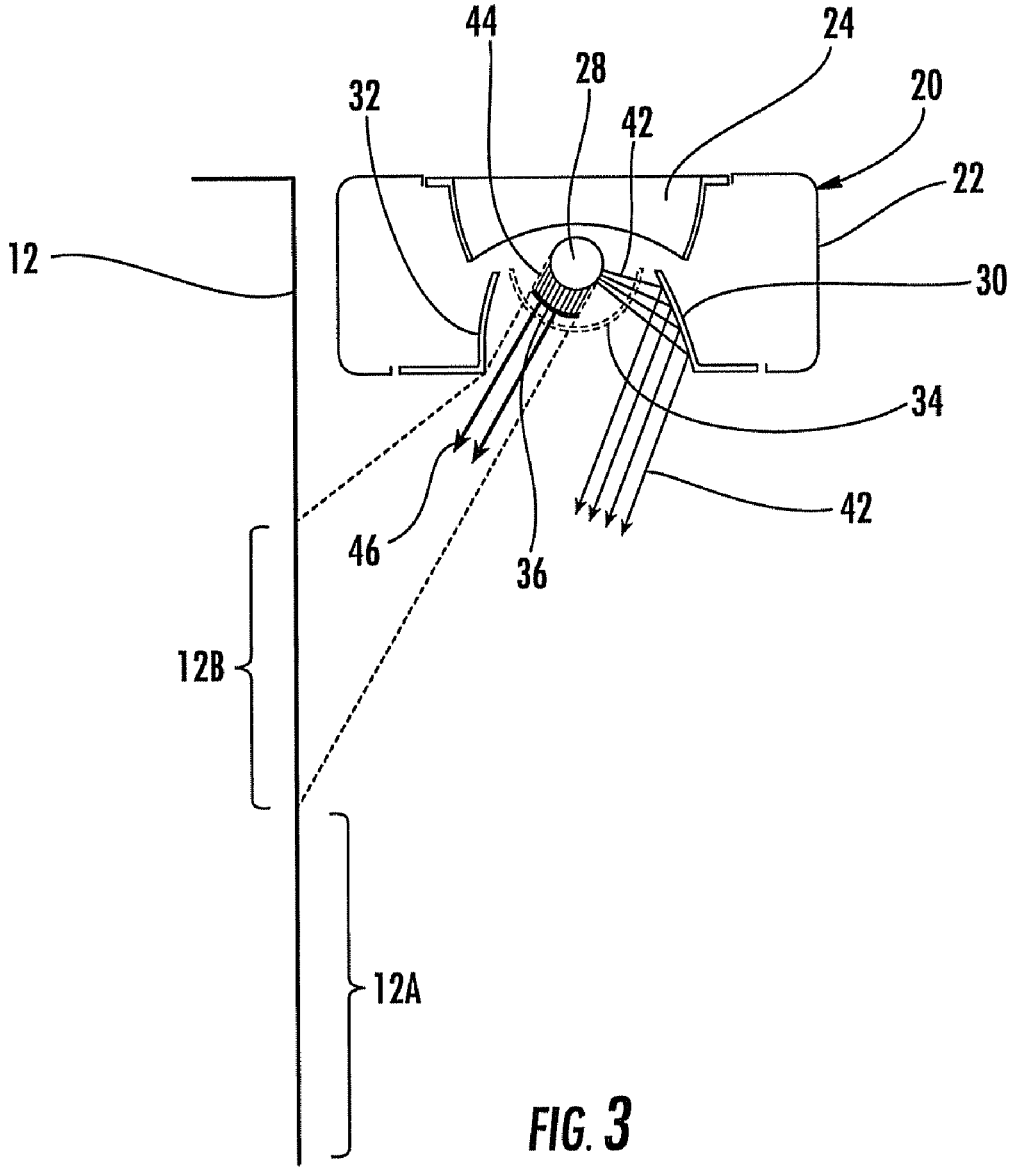
FIG. 3 is another cross-sectional view of the luminaire of FIG. 2 showing a light distribution effect of the luminaire.
Figure 4:
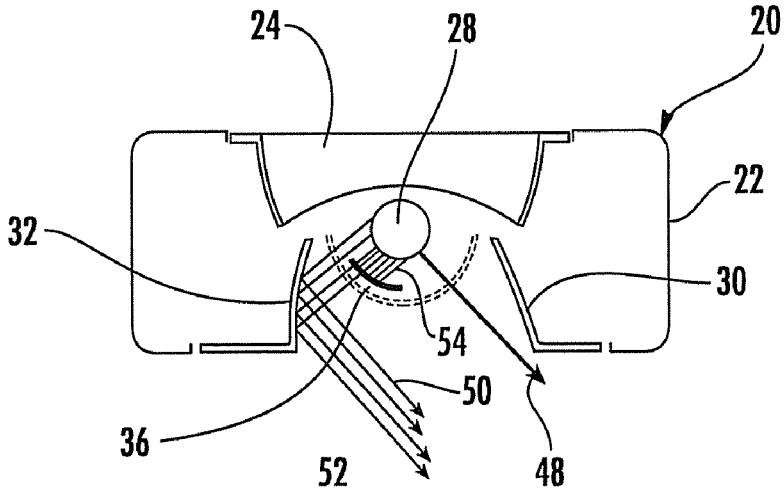
FIG. 4 is another cross-sectional view of the luminaire of FIG. 2 showing another light distribution effect of the luminaire.

FIGS. 3 and 4 show effects of the lamp distribution modifier 36 upon light rays emitted from the lamp 28. For convenience purposes, not all light rays emitted from the lamp 28 are shown in FIGS. 3 and 4 (e.g., light rays directed upward through upper aperture 24 are not shown) but it shall be understood that the lamp 28 emits light in all outward directions relative to the illustrated cross-section.

Referring to FIG. 3, light rays 42 are emitted from the lamp 28 in a direction toward the first reflector 30 which desirably redirects the light rays 42 toward a lower portion 12A of the vertical surface 12. Light rays 44 are emitted from the lamp 28 in a direction toward an upper portion 12B of the vertical surface 12. The lamp distribution modifier 36 is disposed between the lamp 28 and the upper vertical surface portion 12B such that the intercepting features 38 intercept the light rays 44 and thus substantially prevent the light rays 44 from proceeding onward toward the upper portion 12B. Light rays 46 are emitted from the lamp 28 in a direction toward the lamp distribution modifier 36 and are incident upon the light passage features 40. Thus, the light rays 46 are permitted to substantially pass through the lamp distribution modifier 36 so as to illuminate the upper portion 12B of the vertical surface. Notably, the lamp distribution modifier 36 is disposed within the lower aperture 26 closely proximate to the lamp 28. In this manner, the viewer 16 does not have the occasion to readily view the modifier 36, thus preserving the aesthetics of the luminaire 20.

Referring now to FIG. 4, light rays 48 are emitted from the lamp 28 in a direction toward the worksurface 14. As shown, the light rays 48 are not impeded by the first reflector 30 nor by the lamp distribution modifier 36 and thus are able to emanate directly to the worksurface 14. Light rays 50 are emitted from the lamp 28 in a direction toward the second reflector 32. As shown, the light rays 50 emanate adjacent to and unimpeded by the lamp distribution modifier 36 so as to contact the second reflector 32 which redirects the light rays 50 in a direction toward the work surface 14. Light rays 52 represent another set of light rays emitted from lamp 28 in a direction toward the lamp distribution modifier 36 and are incident upon the light passage features 40. Thus, the light rays 52 are permitted to substantially pass through the lamp distribution modifier 36 so as to contact reflector 32 which redirects the light rays 52 in a direction toward worksurface 14. Similarly, light rays 54 are emitted from lamp 28 in a direction toward the lamp distribution modifier 36. However, light rays 54 are incident upon the intercepting features of the lamp distribution modifier 36 and are thus prevented from contacting reflector 32. It is therefore advantageous that the distribution modifier 36 be fashioned, as in the embodiments described below, to intercept light rays 44 (FIG. 3) to a much greater extent than it may intercept light rays 54 (FIG. 4).

It is widely known that luminance on a plane is depreciated by (a) the distance from the source and (b) the cosine of the angle of incidence of the light relative to the plane (measured from a line drawn normal to the surface). Thus, referring again to FIG. 3, in the arrangement of the workstation 10 it is important to provide reduced luminance to the upper portion 12B of the vertical surface due to its proximity to the lamp 28 and due to the angle of light rays incident thereon. Correspondingly, it is also important to provide enhanced luminance to the lower vertical surface portion 12A due to the increased distance of this portion relative to the lamp 28 and due to the increased angle of incident light. The interception of the light rays 44 by the lamp distribution modifier 36, combined with the passage of light rays 46 through the modifier 36, results in a reduced luminance at the upper vertical surface portion 12B. The light rays 42 which bypass the modifier 36 and which are redirected toward the lower vertical surface portion 12A by the first reflector 30 provide an increased luminance at this portion 12A relative to the luminance at portion 12B. Thus, the net effect of the luminaire 20 is a substantially even luminance distribution across the vertical surface 12 despite the proximity of the lamp 28 to the vertical surface 12 and particularly to the upper vertical surface portion 12B, and despite the angle of light incident upon this upper portion 12B.

This uniformity of luminance is provided to the vertical surface 12 with minimal interception of lamp emanations that directly illuminate the worksurface 14 or that can be desirably redirected by the first and or second reflectors 30 and 32 to indirectly illuminate the worksurface 14. This is shown and described herein with respect to FIG. 4 which illustrates light rays 48 emanating directly from the lamp 28 toward the worksurface 14 and light rays 50 and 52 being redirected by the second reflector 32 and thus sent indirectly to the worksurface 14.

The lamp distribution modifier 36 may assume any number of a variety of configurations to provide these numerous advantages to the workstation 10. Several representative configurations are now discussed. Notably all of the exemplary embodiments of the lamp distribution modifier 36 are disposed at an interior of the lower aperture 26 within the housing 22 so as not to intercept light rays exiting the luminaire after being advantageously redirected by reflectors 30 and 32 and so as to be kept out of sight from the viewer to thus preserve the aesthetic integrity of the luminaire 20. Further notably, in many cases the modifier 36 may be retrofit into an existing workstation luminaire.

Figure 5:
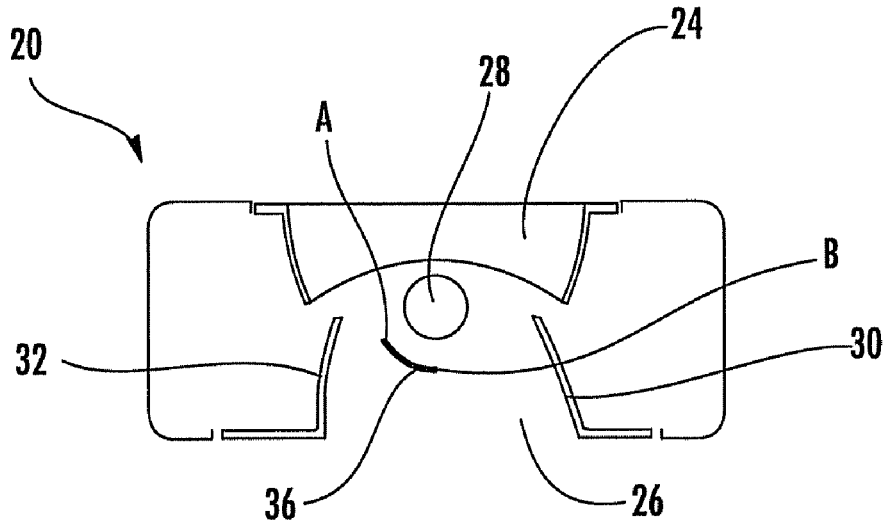
FIG. 5 is an enlarged cross-sectional view of the luminaire of FIG. 2.

FIG. 5 shows a simplified version of the luminaire 20. Here it is shown that the lamp distribution modifier 36 includes a first edge A and an opposite edge B. The modifier 36 includes a varying degree of opacity between the edges A and B. Particularly, the least degree of opacity is found proximate to the edge A. The level of opacity provided by the modifier 36 gradually increases in a direction toward the edge B. Thus, the highest degree of opacity is found proximate to the edge B. That is, the direct lamp emanations intercepted by the lamp distribution modifier 36 is greatest toward the edge B.

The graduating degree of opacity of the lamp distribution modifier 36 may be accomplished by applying or infusing an opaque coating or material onto or into an otherwise clear material. For example, with reference to FIGS. 6A and 6B, the modifier 36 may comprise an elongate member having an arcuate cross-section where the member is formed of a generally transparent material, such as a plastic. This plastic material is then infused or masked with an opaque material or coating to result in the alternating light intercepting features 38 and light passage features. Here, when viewed in plan view as in FIG. 6A, the light intercepting and passage features 38 and 40 are substantially triangular in shape.

The lamp distribution modifier 36 may be disposed within the housing 22 by mounting brackets (not shown) or by fixation to ends of the housing 22 or by any either suitable fixation means. The modifier 36 is preferably disposed at an interior of the lower aperture 26 proximate and close to the lamp 28 so as to be kept out of view from the viewer 16. This avoids aesthetic degradation of the luminaire, prevents the viewer from seeing any glare or reflection exhibited by the lamp distribution modifier 36, etc. In the case where a lens 34 (FIG. 2) is present and is both proximate to the position of, and of a length corresponding to, a desirable lamp distribution modifier, it is herein also conceived that the requisite light intercepting and passage features 38 and 40 may be alternatively infused, masked or otherwise incorporated directly into or onto the lens 34.

Figure 7:
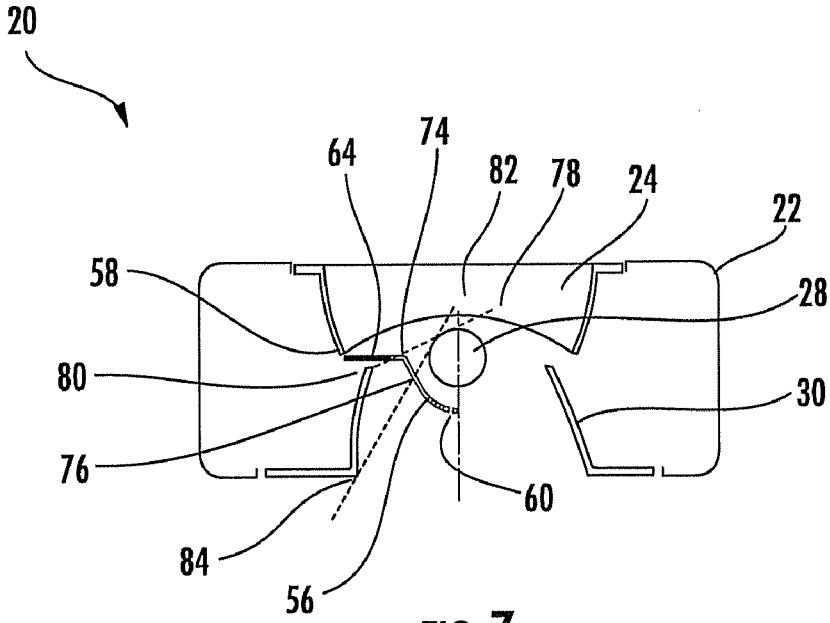
FIG. 7 is a cross-sectional view of a luminaire in another exemplary embodiment of the invention.

FIG. 7 shows the luminaire 20 including a lamp distribution modifier 56 in another exemplary embodiment of the invention. Here, the modifier 56 is fashioned of an opaque material having opposite edges 58 and 60 and openings 62 delimited therebetween, as shown specifically in FIGS. 8A and 8B. An extension flange 64 extends along a length of the lamp distribution modifier 56 proximate to the edge 58. The extension flange 64 allows the modifier 56 to be continuously or intermittently fixed into the luminaire 20 along a length thereof. The extension flange 64 is received and retained in the housing 22 just above the second reflector 32. The flange 64 may be fixed in the housing 22 by way of a friction fit or by any other sufficient means such as screws, bolts, etc. The flange 64 includes mounting holes 66 to facilitate fixation of the flange 64 within the housing 22 of the luminaire 20. The remainder of the modifier 56 extends downward relative to the flange 64 and curves to generally correspond with the circumference of the lamp 28. In this way, the modifier 56 is resultantly disposed within the lower aperture 26 closely proximate to the lamp 28 so as not to intercept light rays exiting the aperture after being advantageously redirected by reflectors 30 and 32 and so as to be not readily viewable by the viewer 16.

Figure 8A:
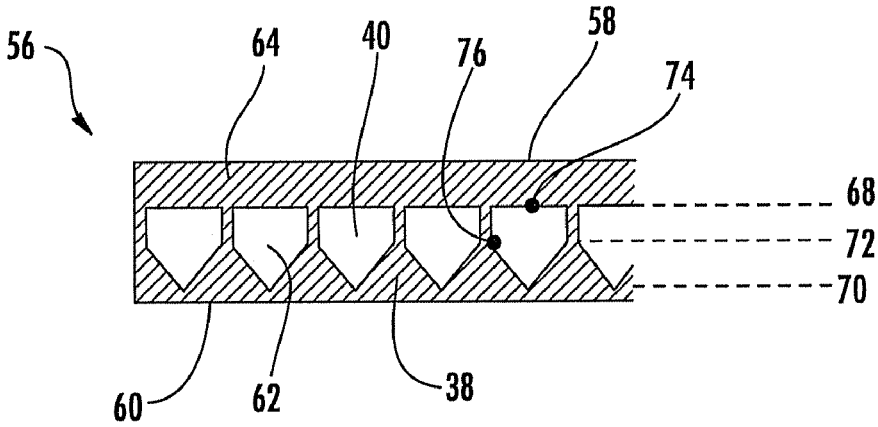
FIG. 8A is an enlarged plan view of a portion of a lamp distribution modifier of the luminaire of FIG. 7, in an exemplary embodiment of the invention.
Figure 8B:
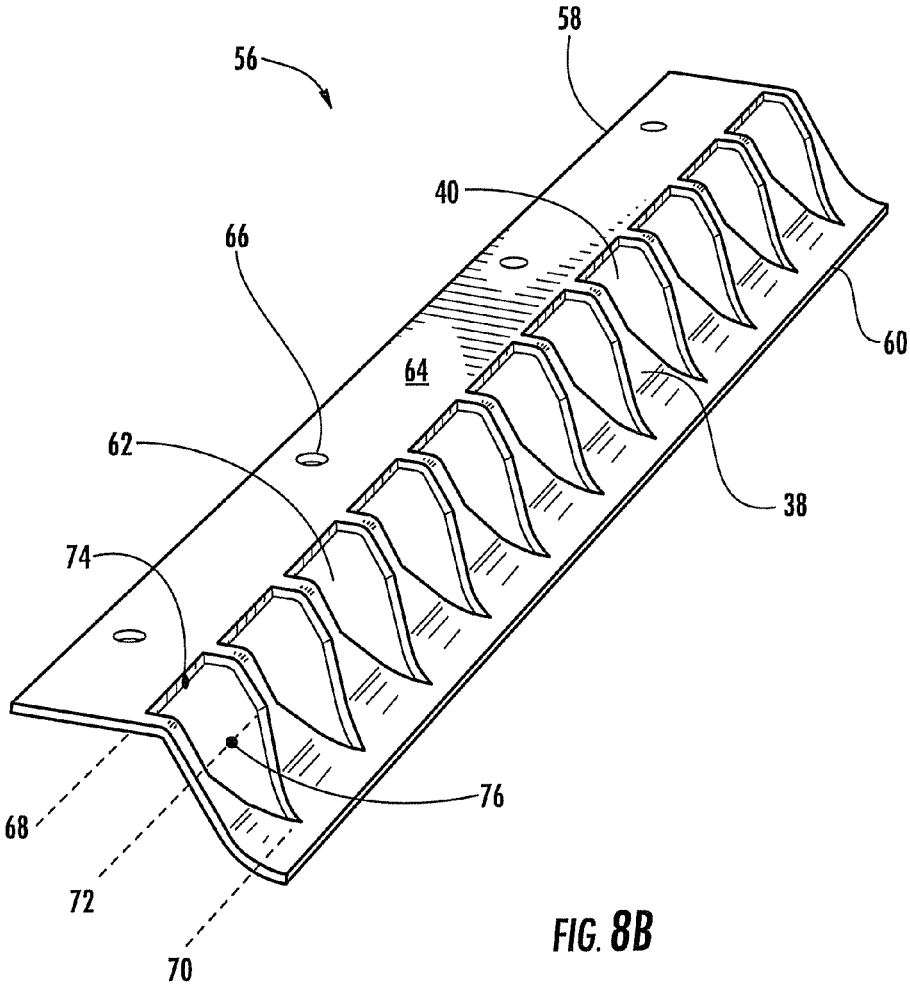
FIG. 8B is a perspective view of the lamp distribution modifier of FIG. 8A.

The openings 62 of the lamp distribution modifier 56 are shown as being substantially pentagonal in shape with their narrowest portion located proximate the edge 60. Of course, the openings 62 may have any shape sufficient to allow light to pass through the modifier 56 as discussed in more detail below. In the embodiment of FIGS. 7, 8A, and 8B, an upper line 68 comprises a line tangent to a side of the openings 62 proximate to the extension flange 64. A lower line 70 represents a line tangent to a portion of the openings most proximate to the edge 60. A mid-line 72 comprises a line extending generally between the upper and lower lines 68 and 70. A point 74 lies on the upper line 68 while a point 76 lies on the mid-line 72. Point 74 is coincident with a line 78 originating at an upper longitudinal edge 80 of the second reflector 32 and tangent to the lamp 28. Point 76 is coincident with a line 82 originating at a lower longitudinal edge 84 of the second reflector 32 and tangent to the lamp 28. As shown particularly in FIG. 8A, the points 74 and 76 define edges of the openings 62.

A portion of the openings 62 disposed between the lines 68 and 72 is maximized to allow maximum direct lamp 28 emanations to pass through the lamp distribution modifier 56 and to enter onto the second reflector 32. A portion of the openings 62 disposed between the lines 70 and 72 is tapered to allow a maximum of lamp 28 emanations to enter onto the second reflector while reducing the direct lamp 28 emanations incident on the vertical surface 12 of the workstation 10.

The lamp distribution modifier 56 of FIG. 7 is similar to the modifier 36 discussed above in that the modifier 56 provides increasing opacity in a direction from the edge 58 toward the edge 60. The opaque material forming the modifier 56 delimits the light intercepting features 38 proximate to the edge 62 and the light passage features 40 in the form of the openings 62. The lamp distribution modifier 56 operates similarly to the modifier 36 discussed above. Particularly, the openings 62 permit light rays 46 (see FIG. 3) to pass from the lamp 28 through the lamp distribution modifier 56 directly to the upper portion 12B of the vertical surface 12. Further, the light intercepting features 38 intercept light rays 44 thus preventing them from passing on to the upper vertical surface portion 12B. The result is a reduction of light rays incident upon the upper vertical surface portion 12B relative to the lower portion 12A. The net effect is an even luminance distribution across the vertical surface 12.

Of course the pentagonal shaped openings 62, their regular spacing along the length of the lamp distribution modifier 56 and their identical size and shape (one to another) are only provided herein by way of example only. The openings 62 may possess any desirable shape and/or arrangement sufficient for providing the light distribution modification as intended by the broad scope of the invention. For example, the openings 62 may be triangular in shape, quadrilateral, curvilinear, etc. Likewise, openings of a multiplicity of shapes and/or sizes may be applied in a single embodiment of the invention.

Figure 9:
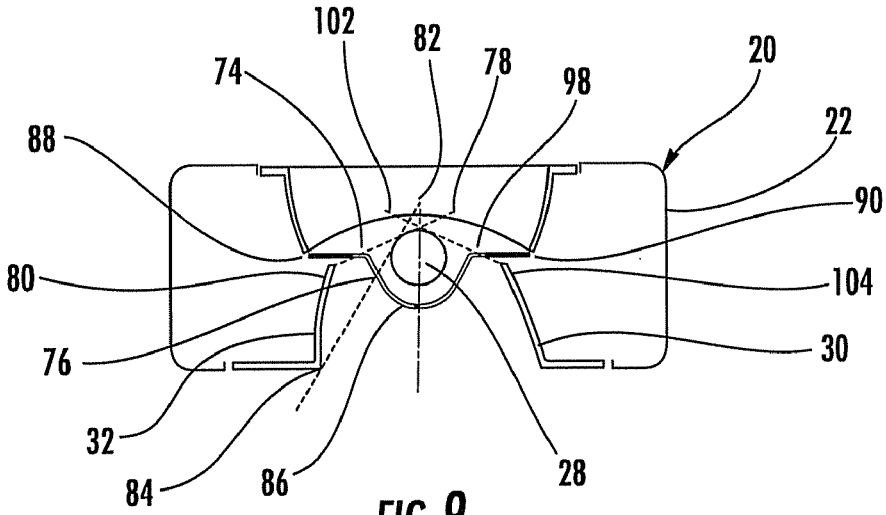
FIG. 9 is a cross-sectional view of a luminaire in another exemplary embodiment of the invention.

FIG. 9 shows the luminaire 20 including a lamp distribution modifier 86 in another exemplary embodiment of the invention. Here, the modifier 86 is fashioned of an opaque material having opposite edges 88 and 90. The modifier 86 delimits the openings 62 as described above with reference to FIGS. 7, 8A, and 8B. (See, FIGS. 10A and 10B.) The modifier 86 also delimits second openings 93 disposed proximate to the edge 90. The modifier 86 includes the extension flange 64 as addressed above which, here, extend along a length of the lamp distribution modifier 86 proximate to the edge 88. A second extension flange 95 extends along the length of the modifier 86 proximate to the edge 90. The extension flanges 64 and 95 allow the modifier 86 to be continuously or intermittently fixed into the luminaire 20 along a length thereof. The extension flange 64, as discussed with reference to the modifier 56, is received and retained in the housing 22 just above the second reflector 32. The extension flange 95 is similarly received and retained above the first reflector 30. The flanges 64 and 95 may be fixed in the housing 22 by way of a friction fit or by any other sufficient means such as screws, bolts, etc. The flanges 64 and 95 include mounting holes 96 to facilitate fixation of the flanges 64 and 95 within the housing 22 of the luminaire 20.

In this embodiment, the dual flanges 64 and 95 provide a simple means of support and a more positive alignment of the lamp distribution modifier 86 within the housing 22 of the luminaire 20 while still allowing for the desired interception and passage of light rays emanating from the lamp 28. The flanges 64 and 95 also result in a secure and close disposition of the modifier 86 relative to the lamp 28. In this way, the modifier 86 does not intercept light rays exiting the aperture from reflectors 30 and 32 and is kept out of the view of the viewer 16.

Figure 10A:
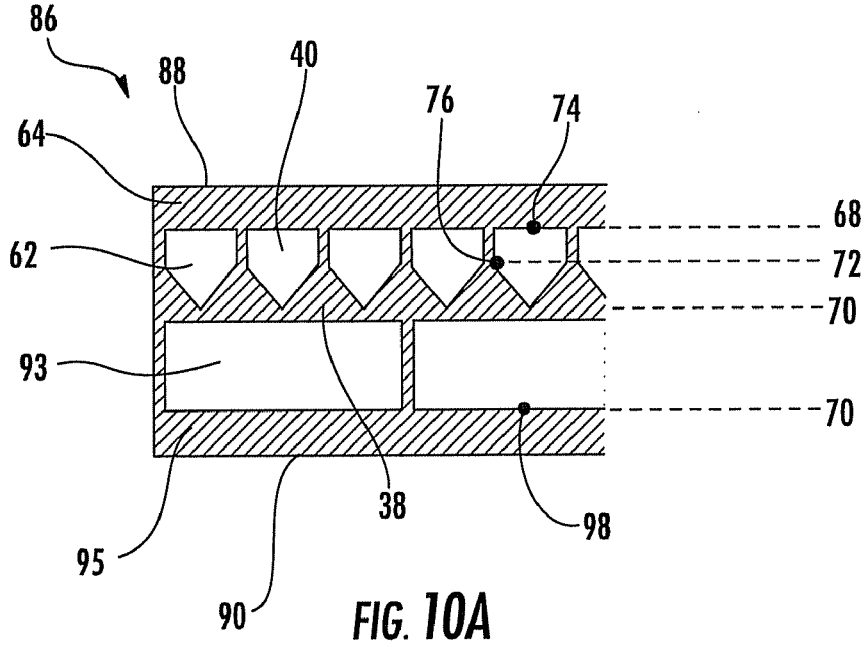
FIG. 10A is an enlarged plan view of a portion of a lamp distribution modifier of the luminaire of FIG. 9, in an exemplary embodiment of the invention.
Figure 10B:
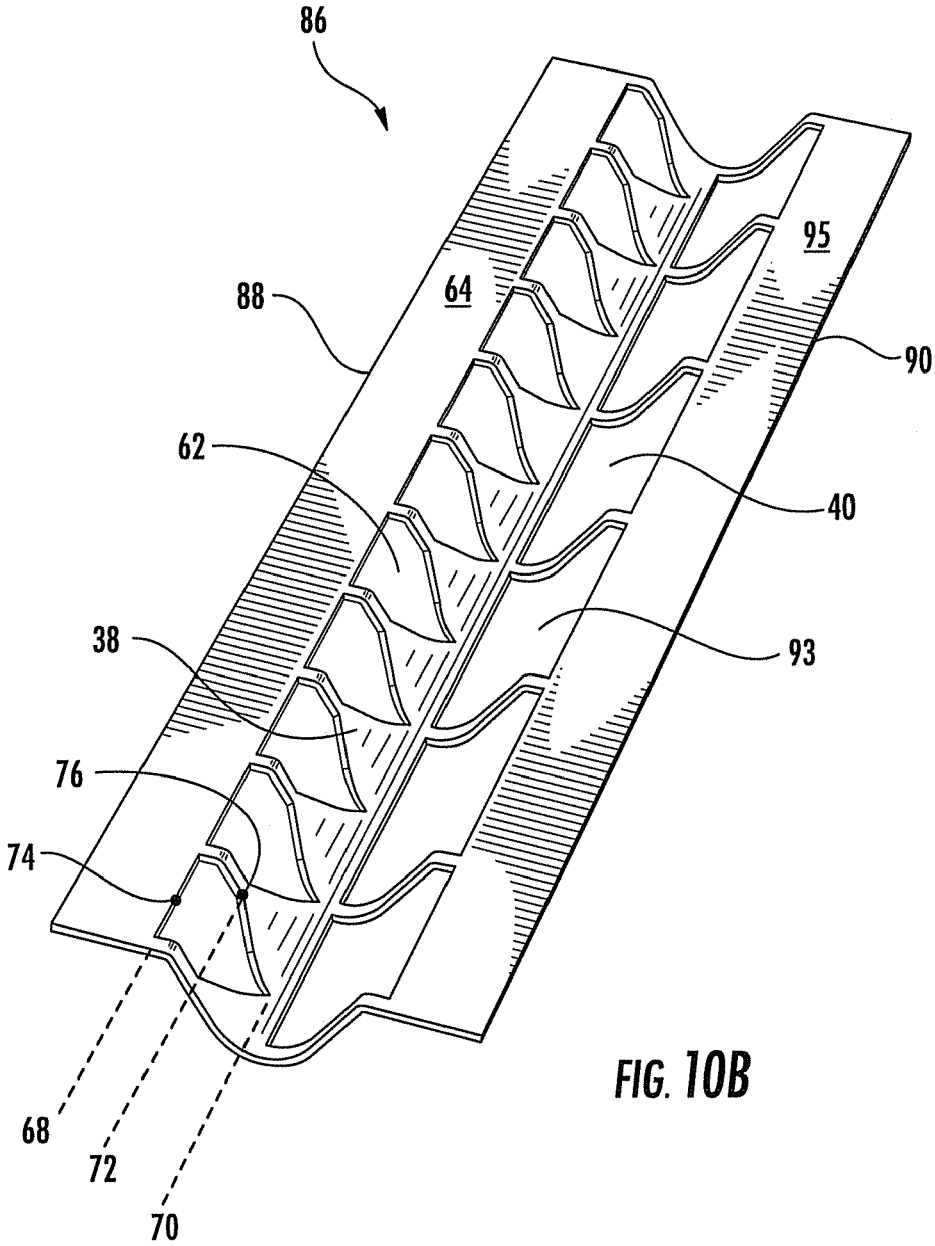
FIG. 10B is a perspective view of the lamp distribution modifier of FIG. 10A.

The lamp distribution modifier 86 of FIGS. 9, 10A, and 10B includes the upper, lower, and mid-lines 68, 70, and 72, respectively, described above with reference to FIGS. 7, 8A, and 8B. The modifier also includes the points 74 and 76 coincident with the lines 78 and 82, respectively, as also described above. A point lies along a line 100 which traces an edge of the second openings 93 proximate to the edge 90 of the modifier 86. This point 98 is coincident with a line 102 which originates at an upper longitudinal edge 104 of the first reflector 30 extends tangent to the lamp 28.

The openings 62 of the lamp distribution modifier 86 are discussed in detail above with respect to the modifier 56. Essentially, a portion of the openings 62 between the lines 68 and 72 is maximized to allow light emanating from the lamp 28 to pass directly through the modifier 86 to the second reflector 32. Further, a portion of the openings 62 between the lines 70 and 72 is tapered to allow a maximum of lamp 28 emanations to enter onto the second reflector while reducing the direct lamp 28 emanations incident on the upper vertical surface portion 12B of the workstation 10.

The second openings 93 of the lamp distribution modifier 86 are generally rectangular in shape and are maximized to allow the maximum direct lamp 28 emanations to exit the lower aperture 26 of the luminaire 20 toward the worksurface 14 and to allow the maximum lamp 28 emanations to enter onto the first reflector 30 for redirection to the lower portion 12A of the vertical surface 12. (See, FIGS. 1-3.)

Here again, the lamp distribution modifier 86 operates similarly to the modifiers 36 and 56 discussed above. Particularly, the openings 62 permit light rays 46 (see FIG. 3) to pass from the lamp 28 through the lamp distribution modifier 86 directly to the upper portion 12B of the vertical surface 12. Further, the light intercepting features 38 intercept light rays 44 thus preventing them from passing on to the upper vertical surface portion 12B. Additionally, the openings 93 allow virtually unimpeded propagation of the light rays 42 and 48 to the first reflector 30 and to the worksurface 14, respectively. The result is a reduction of light rays incident upon the upper vertical surface portion 12B relative to the lower portion 12A and uninhibited passage of light rays to the worksurface 14. The net effect of the modifier 86 is an even luminance distribution across the vertical surface 12 and the worksurface 14 while the modifier 86 is maintained out of view from the viewer 16 so as to preserve the aesthetic quality of the luminaire 20.

Figure 10C:
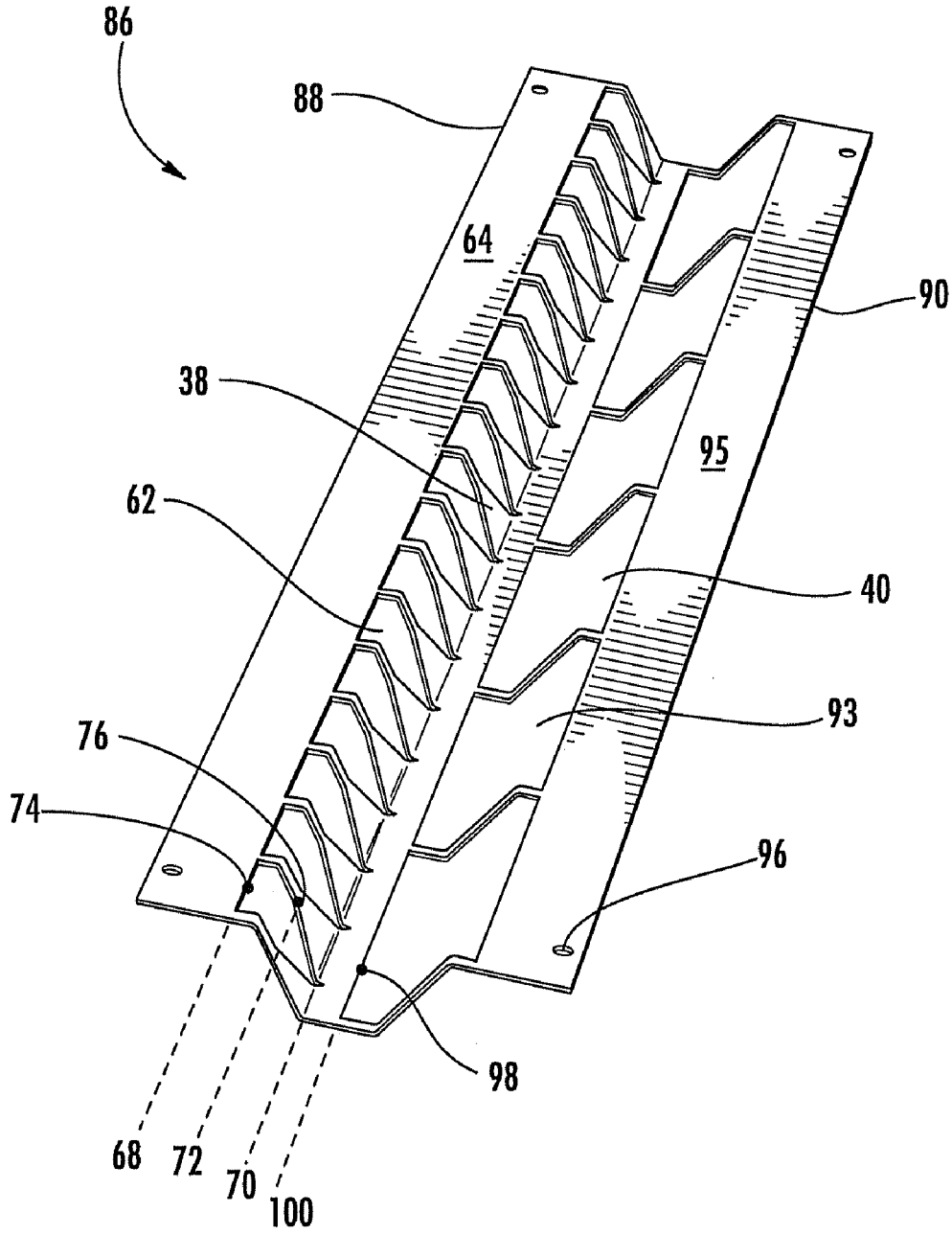
FIG. 10C is a perspective view of a lamp distribution modifier in another exemplary embodiment of the invention.

FIG. 10C shows the lamp distribution modifier 86 in a different embodiment of the invention where the lower portion of the modifier 86 proximate to the line 70 is angular whereas this portion is more rounded in the embodiment of FIG. 10B.

Figure 10D:
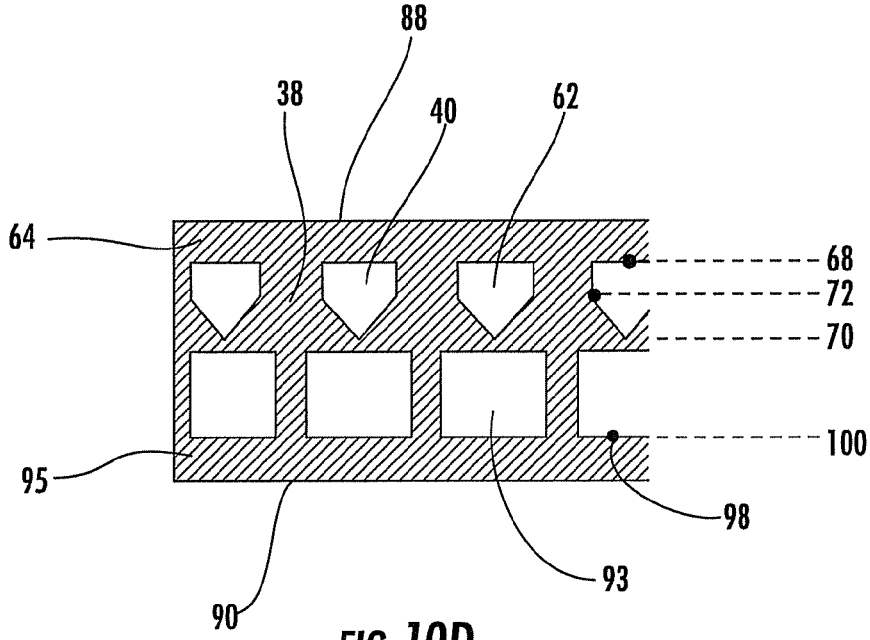
FIG. 10D is an enlarged plan view of a portion of a lamp distribution modifier in another exemplary embodiment of the invention.
Figure 10E:
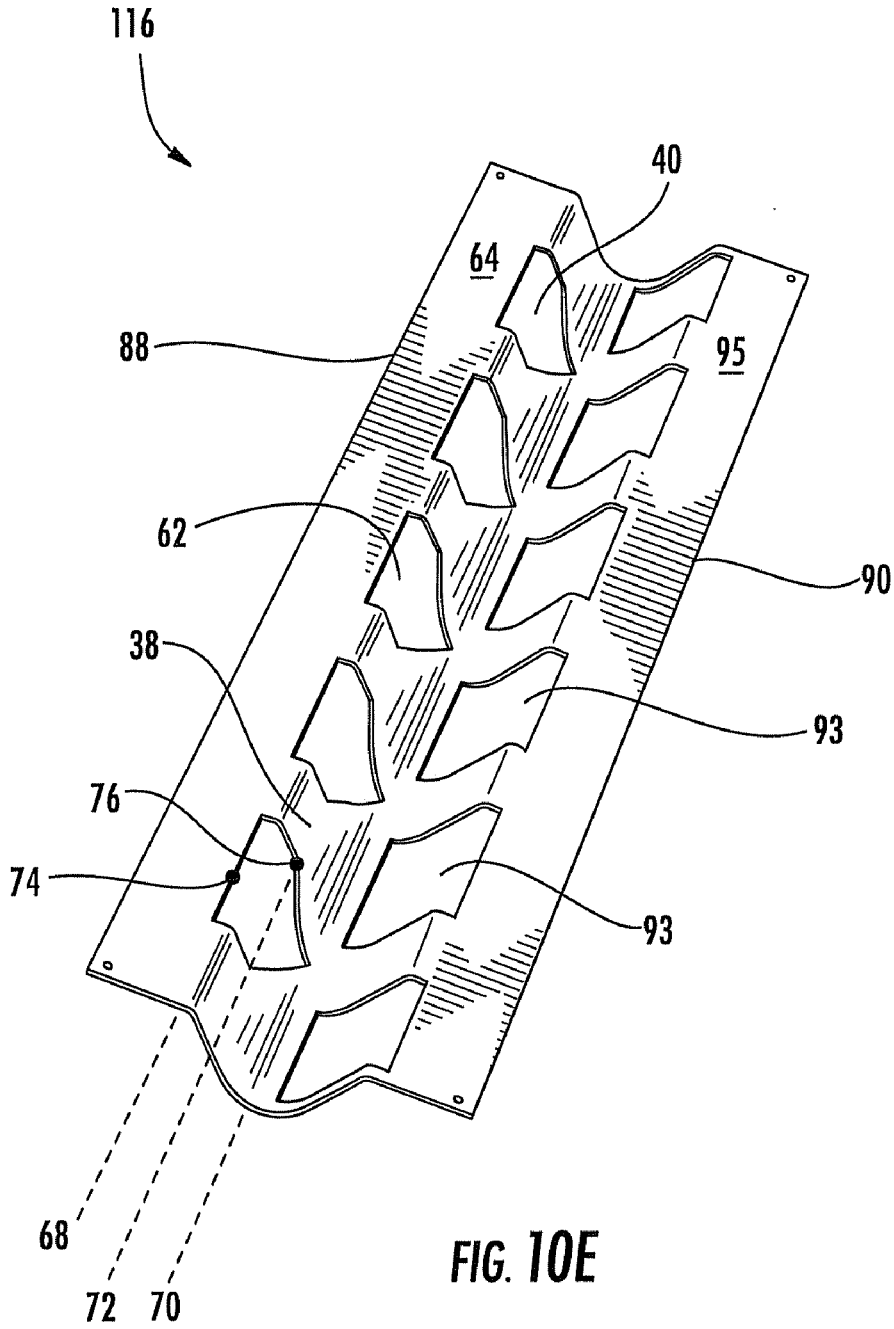
FIG. 10E is a perspective view of the lamp distribution modifier of FIG. 10D.

FIGS. 10D and 10E show a lamp distribution modifier 116 in another embodiment of the invention. Here, the openings 62, 93 are reduced in number and/or size to effect a reduction of illuminance on the vertical surface 12 and/or on the worksurface 14 and/or to allow for use of a higher-output lamp 28 in the luminaire 20 to achieve greater uplight output through the upper aperture 24 without affecting the downlight output through the lower aperture 26 of the luminaire 20. Of course the modifier 86 can take any shape or size to provide the desired lamp modification.

In accordance with another exemplary embodiment of the invention, at least a portion of a side of the lamp distribution modifier 36, 56, 86, 116 facing the lamp 28 is provided with a reflective finish (not shown). That is, at least a portion of the side of the modifier 36, 56, 86, 116 which faces the lamp 28 includes this reflective finish formed integrally on to the modifier 36, 56, 86, 116, coated thereon, etc. The reflective finish causes light that is intercepted by the modifier 36, 56, 86, 116 to be redirected and distributed out through the upper aperture 24 in order to contribute to uplighting provided by the luminaire 20.

Figure 11:
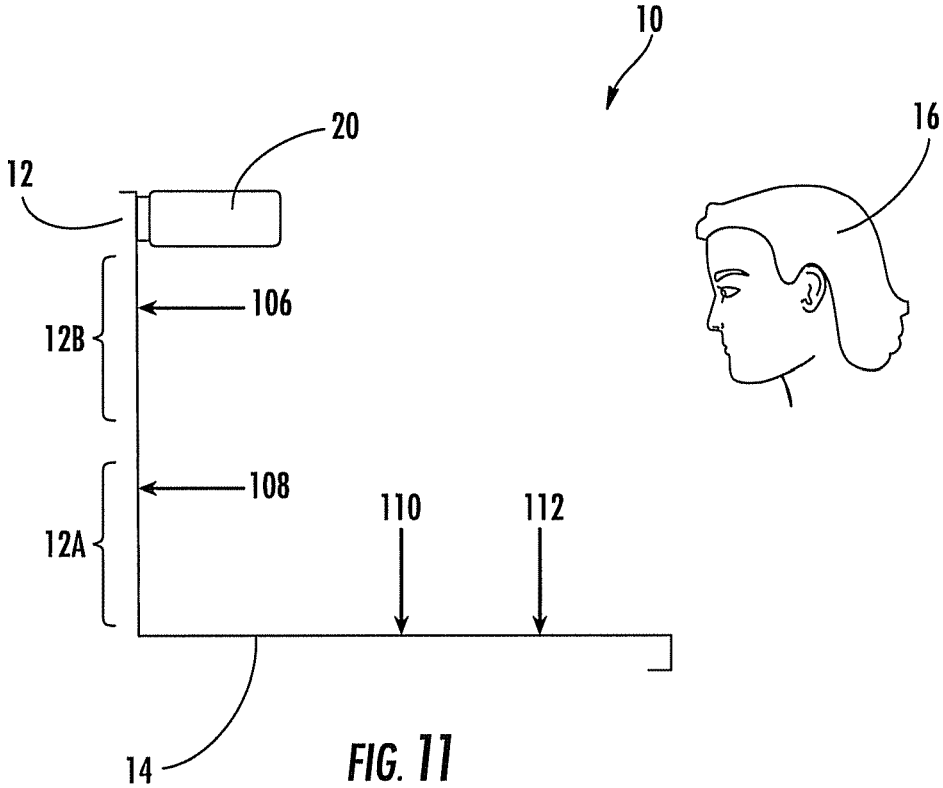
FIG. 11 is another view of the workstation of FIG. 1.

FIG. 11 shows the effect of the lamp distribution modifier 36, 56, 86, 116 on the workstation 10. Where illuminance generated by the luminaire 20 at points 106, 108, 110, and 112 are measured perpendicular to the respective vertical surface 12 and worksurface 14, both with and without the lamp distribution modifier 36, 56, 86, 116 installed in the luminaire, it is found that the modifier 36, 56, 86, 116 results in an illuminance reduction at point 106 of approximately 50and a corresponding illuminance reduction at point 108 of approximately 30%. This greatly improves luminance uniformity on the vertical surface and reduces the maximum illuminance to acceptable and desirable levels.

In one experiment, illuminance measurements taken perpendicularly at points 106, 108, 110, and 112 were, respectively, 195*fc*, 55*fc*, 110*fc* and 90*fc*. Where the lamp distribution modifier of the invention was installed in the luminaire 20, the illuminance measurements taken at points 106, 108, 110, and 112 were, respectively, 96*fc*, 36*fc*, 91*fc* and 75*fc*. That is, the modifier resulted in an approximately 51% illuminance reduction at point 106 while only reducing illuminance approximately 35% at point 108. Thus, the uniformity on the vertical surface 12 is improved from 3.5:1 to 2.7:1 and the maximum illuminance was reduced to an acceptable level (<114*fc*). At the same time, the illuminance at points 110 and 112 was reduced only 11% and 17% respectively.

Advantageously, the invention provides a luminaire that offers improved luminance distribution across a vertical mounting surface and an associated worksurface. Specifically, a luminaire is provided having a lamp distribution modifier which reduces luminance on the vertical mounting surface proximate to the luminaire while maintaining sufficient luminance on areas of the mounting surface disposed distally relative to the luminaire and across the associated worksurface, where such feature is discrete so as not to detract from the aesthetics of the luminaire, and where such feature is cost-effectiveness, easy to install, and capable of retrofit and reposition.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A luminaire for mounting on a vertical surface, the luminaire comprising:

a housing having an aperture;

a lamp disposed within the aperture and configured to emit light through the aperture to the vertical surface and to an associated worksurface; and a lamp distribution modifier disposed within the aperture proximate to the lamp, an entirety of said lamp distribution modifier being disposed closer to said lamp than an exterior aperture opening;

wherein the lamp distribution modifier is configured to intercept first light rays emitted by the lamp in a direction toward an upper portion of the vertical surface, wherein the lamp distribution modifier is further configured to allow passage of second light rays emitted by the lamp in a direction toward the upper portion of the vertical surface, and wherein the lamp distribution modifier is further configured to allow passage of third light rays to a reflector disposed within the aperture, wherein the reflector redirects the third light rays to at least one of a lower portion of the vertical surface and the worksurface.

2. The luminaire of claim 1, wherein the lamp distribution modifier comprises a substantially transparent elongated member disposed within the luminaire along at least part of a length of lamp where the member includes one or more areas of opacity disposed to intercept the first light rays, wherein the area of opacity delimits a region of increasing opacity.

3. The luminaire of claim 2, wherein the lamp distribution modifier further comprises a lens of the lamp.

4. The luminaire of claim 2, wherein the lamp distribution modifier is disposed proximate to the lamp, between the lamp and a lens.

5. The luminaire of claim 1, wherein the lamp distribution modifier is disposed adjacent and proximate to the lamp within the aperture such that the lamp distribution modifier is not directly visible to a viewer of the luminaire.

6. The luminaire of claim 1, wherein the lamp distribution modifier comprises an opaque elongated member comprising at least one area of opacity to intercept the first light rays, wherein the area of opacity delimits a region of increasing opacity, the lamp distribution modifier further comprising openings formed therethrough for passage of second light rays through the modifier to at least one of a reflector disposed within the aperture, the vertical surface, and the worksurface.

7. The luminaire of claim 6, wherein the lamp distribution modifier comprises at least one elongated mounting flange for fixing the modifier within the luminaire, wherein the areas of opacity extend from the mounting flange, and wherein the openings are disposed adjacent to the areas of opacity, and wherein the increasing opacity generally increases in a direction substantially away from the mounting flange.

8. The luminaire of claim 7, wherein the areas of opacity and the openings are substantially triangular in shape, wherein the openings are arranged inverted relative to the areas of opacity, and wherein the openings are arranged generally complementary to the areas of opacity.

9. The luminaire of claim 7, wherein the lamp distribution modifier comprises a first mounting flange configured to extend at least partly along a length of the lamp, wherein the areas of opacity are configured to extend substantially along at least a part of the length of the lamp and substantially around a periphery of the lamp.

10. The luminaire of claim 9, wherein the lamp distribution modifier comprises a second elongated mounting flange disposed generally opposite from the first mounting flange and configured to extend at least partly along a length of the lamp, the first and second mounting flanges supporting the lamp distribution modifier on opposite sides of the lamp, the lamp distribution modifier further comprising one or more support elements extending from the second flange to the areas of opacity openings delimited between the support elements for allowing light rays to pass through the lamp distribution modifier in a direction toward the worksurface.

11. The luminaire of claim 10, wherein areas of opacity and the support elements generally extend around a periphery of the lamp such that the lamp is contained within the lamp distribution modifier.

12. The luminaire of claim 1, wherein the interception of the first light rays reduces illuminance of the upper portion of the vertical surface by approximately 50% and wherein the lamp distribution modifier reduces illuminance of a lower portion of the vertical surface by less than approximately 35%.

13. The luminaire of claim 12, wherein the lamp distribution modifier reduces illuminance of a worksurface disposed in association with the vertical surface by less than approximately 10-20% and wherein the lamp distribution modifier modifies illuminance uniformity on the vertical surface from approximately 3.5:1 to 2.7:1.

14. A lamp distribution modifier for being disposed proximate to a lamp within an interior of a downlight luminaire, comprising:

an elongated body configured to extend along at least a part of a length of the lamp;

a light passage feature disposed on the body configured to allow first light rays incident on a vertical surface to pass through the lamp distribution modifier; and a light intercepting feature disposed on the body and configured to intercept second light rays incident on the vertical surface;

wherein the body is disposed so as not to be directly visible to a viewer of the luminaire, wherein the body comprises an opaque elongated member which extends substantially the length of the lamp, wherein the light intercepting feature comprises areas of opacity of the body which delimits a region of increasing opacity, wherein the light passage feature comprises openings formed through the body, wherein the lamp distribution modifier comprises at least one elongated mounting flange for fixing the modifier within the luminaire, wherein the areas of opacity extend from the mounting flange, and wherein the openings are disposed adjacent to the areas of opacity, and wherein the increasing opacity generally increases in a direction substantially away from the mounting flange.

15. The lamp distribution modifier of claim 14, wherein the light intercepting feature comprises at least one area of opacity delimiting a region of increasing opacity, wherein the light passage feature comprises at least one area of transparency or at least one opening formed through the body, wherein the body is configured to extend at least partially around a periphery of the lamp, and wherein the body is further configured to allow passage of third light rays to a worksurface associated with the vertical surface.

16. A method of modifying light incident on a vertical surface emitted by a lamp of a luminaire mounted proximate to the vertical surface, the method comprising:

disposing a lamp distribution modifier within an aperture of the luminaire proximate to the lamp so as not to be directly viewable by a viewer of the luminaire, an entirety of said lamp distribution modifier being disposed closer to said lamp than an exterior aperture opening;

intercepting first light rays at the lamp distribution modifier incident on an upper portion of the vertical surface proximate to the luminaire;

allowing passage of second light rays through the lamp distribution modifier incident on the upper portion of the vertical surface and incident on a lower portion of the vertical surface disposed distal from the luminaire; and allowing passage of third light rays through the lamp distribution modifier incident on at least one of a reflector of the luminaire or a worksurface associated with the vertical surface, wherein the reflector is disposed to redirect the third light rays to the lower portion of the vertical surface or to a worksurface associated with the vertical surface.

* * * * *